US005404940A

United States Patent [19]

van den Nieuwenhuizen et al.

[11] Patent Number: 5,404,940

[45] Date of Patent: Apr. 11, 1995

[54] TIE BAR CLIP CONSTRUCTION FOR HEAT EXCHANGERS

[75] Inventors: Jan van den Nieuwenhuizen, Nistelrode; Joos de Hoog, Mill, both of Netherlands

[73] Assignee: Modine Manufacturing Co., Racine, Wis.

[21] Appl. No.: 97,393

[22] Filed: Jul. 23, 1993

[51] Int. Cl.[6] ..... F28D 1/00

[52] U.S. Cl. ..... 165/149; 165/906

[58] Field of Search ..... 165/149, 76, 906

[56] References Cited

U.S. PATENT DOCUMENTS

| | | | |
|---|---|---|---|
| 2,056,318 | 10/1936 | Hammond | 165/149 |
| 2,615,687 | 10/1952 | Simmons | 165/149 |
| 3,894,580 | 7/1975 | Chartet | 165/149 X |
| 4,398,332 | 8/1983 | Rhodes | 165/148 X |
| 4,719,967 | 1/1988 | Scarselletta | 165/149 X |
| 5,004,045 | 4/1991 | Le Gauyer | 165/149 |
| 5,129,446 | 7/1992 | Beamer | 165/149 X |

FOREIGN PATENT DOCUMENTS

| | | | |
|---|---|---|---|
| 1552192 | 1/1969 | France | 165/149 |
| 3045087 | 7/1982 | Germany | 165/149 |
| 3904843 | 9/1989 | Germany . | |
| 288485 | 10/1992 | Japan | 165/149 |
| 2120769 | 12/1983 | United Kingdom | 165/149 |
| 2123943 | 2/1984 | United Kingdom | 165/149 |

*Primary Examiner*—John Rivell
*Assistant Examiner*—L. R. Leo
*Attorney, Agent, or Firm*—Wood, Phillips, VanSanten, Clark & Mortimer

[57] ABSTRACT

Increased resistance to deformation caused by internal pressure within a heat exchanger acting in a direction generally transverse to the length of tubes (18) extending between spaced headers (10,12) is achieved in a construction wherein side pieces (22) sandwiching the core defined by the tubes (18) and interposed fins (20) are coupled by means of tie bars (30) having transverse ends (32) embracing the side pieces (22). Resilient clips (40) act to secure the tie bars (30) to the side pieces (22) and include retention notches (54) to positively hold the clips (40) assembled to the structure.

8 Claims, 2 Drawing Sheets

TIE BAR CLIP CONSTRUCTION FOR HEAT EXCHANGERS

FIELD OF THE INVENTION

This invention relates to heat exchangers as, for example, radiators for the coolant employed with internal combustion engines, and more specifically, to a tie bar and clip construction useful in such heat exchangers.

BACKGROUND OF THE INVENTION

Many heat exchangers today, as, for example, vehicular radiators, employ so called flattened tubes extending between opposed headers. Serpentine fins are disposed between and bonded to the flattened tubes on the flat side walls thereof.

In operation, the fluid within the heat exchanger, typically an engine coolant, receives heat rejected from the heat source such as an internal combustion engine and as a consequence, has its temperature elevated. This, in turn, means that the internal pressure within the heat exchanger is likewise elevated. Because the tubes are flattened, internal pressures will be acting against a flat inner surface of the flat side walls of the tubes and as is well known, this pressure will tend to make the tubes "go round".

In plate fin heat exchangers, the plate fins provide necessary pressure restraint by positively confining the tube side walls. Serpentine fins, however, may have insufficient strength to confine the tubes to prevent the tube minor dimensions from expanding in response to pressure. As a consequence, upon pressurization, a heat exchanger may tend to "grow" in the direction transverse to the direction of the elongation of the tubes.

To avoid this problem, heat exchangers are conventionally provided with side pieces which sandwich the tubes and the serpentine fins. The side pieces typically extend between the headers as do the tubes, and are frequently formed of channels for enhanced rigidity. Thus, expanding forces transverse to the direction of elongation of the tubes may be transmitted to the side pieces of the resulting heat exchanger core to be resisted by the strength provided by the side pieces, as well as the headers themselves which may serve to anchor opposite ends of the side pieces in many heat exchanger constructions.

While this type of constraint works well in a number of instances, generally, its success is limited to relatively small heat exchangers having relatively short tubes and side pieces. In larger heat exchangers having relatively long tubes and side pieces, it is generally been necessary to increase the rigidity of the side pieces to resist the deformation due to internal pressure within the heat exchanger. This in turn has increased the cost of heat exchangers as a result of the additional material required. It has also increased the weight of heat exchangers for the same reason.

The present invention is directed to overcoming one or more of the above problems.

SUMMARY OF THE INVENTION

It is the principal object of the invention to provide a new and improved heat exchanger as, for example, a radiator for engine coolant, with improved means for resisting deformation in a direction transverse to the direction of tube elongation as a result of internal pressures within the radiator.

More specifically, it is an object of the invention to provide such means that are easily applied to the heat exchanger and which are extremely reliable in service.

An exemplary embodiment of the invention achieves the foregoing objects in a heat exchanger construction which includes a pair of spaced headers, each having a plurality of tube receiving holes with the tube receiving holes in one header being aligned with and facing the tube receiving holes in the other. A plurality of elongated tubes extend between and are secured to the headers and have opposite ends sealingly received in aligned ones of the holes in the headers. Fins are disposed between and secured to adjacent ones of the tubes to define, with the tubes, a radiator core. A pair of side pieces sandwich the core. The side pieces extend between the headers.

According to the invention, at least one tie bar extends between the side pieces to provide restraint and pressure resistance to the core in a direction generally transverse to the direction of elongation of the tubes. At least one clip is used at one end of the tie bar and fitted over the tie bar and one of the side pieces to secure the two together. In a preferred embodiment of the invention, there are two of the clips, one for each end of the tie bar and the associated end piece.

A highly preferred embodiment contemplates that there be two of the tie bars, one for each side of the core.

In one form of the invention, each side piece is a channel having spaced legs and oriented to open away from the core. Each tie bar has a transverse end fitted over one of the channel legs and the clip has a first securing section that fits over the tie bar and the channel leg to secure the tie bar to the channel leg. The clip also has a second section including retaining means that fits over and grasps the tie bar to hold the first section in place and against movement due to vibration, pressure cycling, thermal cycling or the like.

In a highly preferred embodiment, the clip is resilient and is generally U-shaped. The first section comprises both legs and the bight of the U-shaped clip. One of the legs of the U-shaped clip includes a slot having a width about that of the corresponding dimension of the transverse end of the tie bar so as to be able to receive the same. At least one retaining notch is located in a side of the slot for engagement with the transverse end to hold the clip thereon.

In a highly preferred embodiment, there are two retaining notches, one on each side of the slot, and aligned with each other. The slot, at the location of the retaining notches, is somewhat narrower than the corresponding dimension of the tie bar so that the resilience of the clip tends to close the slot and bring the notches into retaining engagement with the tie bar.

In one embodiment, the notches each have retaining surfaces facing the bight and the slot has tapered sides extending to the retaining surfaces.

In a highly preferred embodiment, the slot extends across the bight and partially into the other leg to facilitate entry of the tie bar into the slot.

Other objects and advantages will become apparent from the following specification taken in connection with the accompanying drawings.

DESCRIPTION OF THE PREFERRED EMBODIMENT

Figure 1:
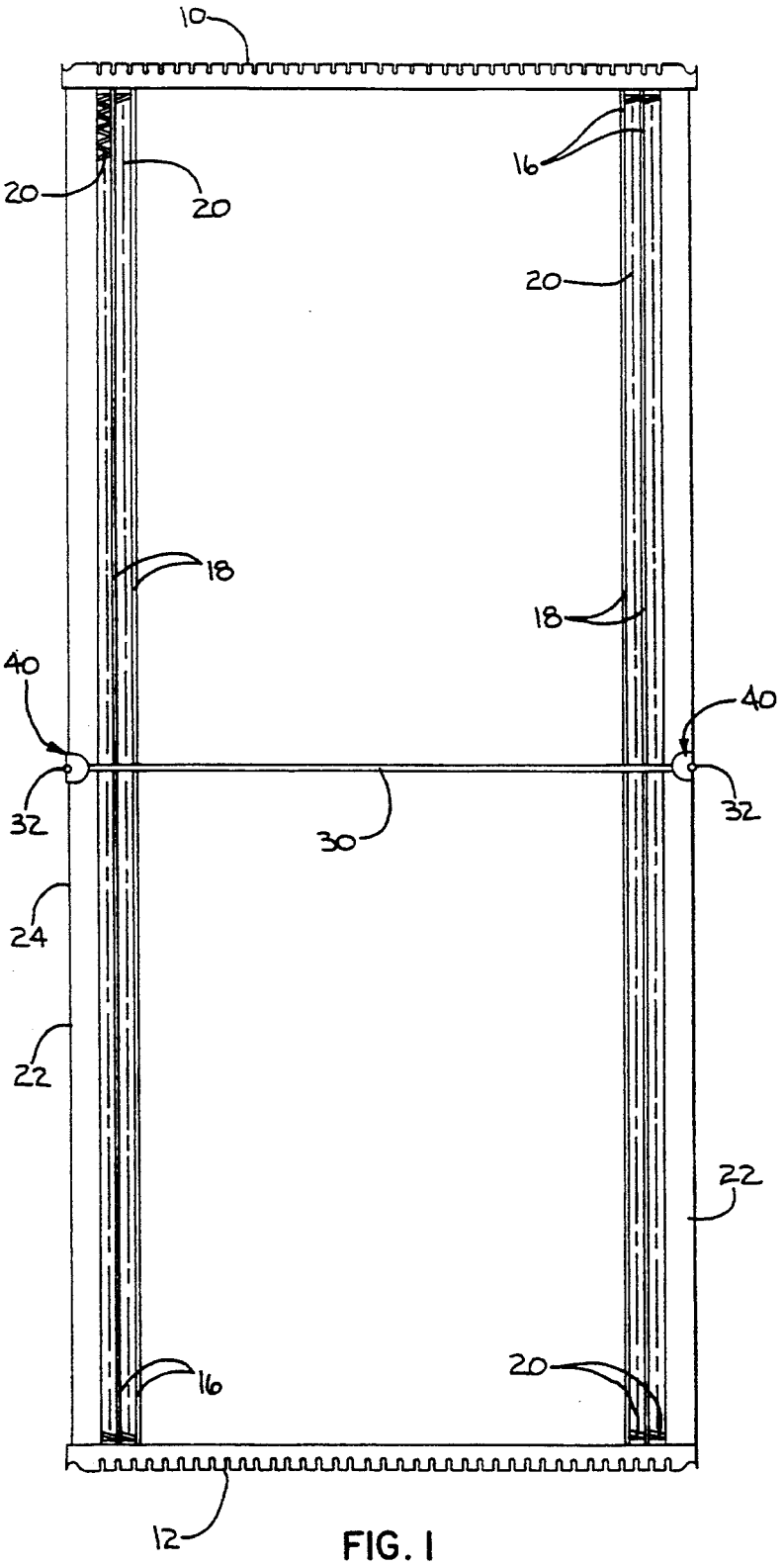
FIG. 1 is a front elevation of a heat exchanger, specifically, a radiator, made according to the invention.

An exemplary embodiment of a heat exchanger made according to the invention is illustrated in the drawings, generally in the context of a radiator for cooling the coolant of an internal combustion engine as might be employed in vehicular applications. However, it is to be understood that the invention is not restricted to vehicular applications, or even to an application wherein the heat exchanger is employed for cooling the coolant of an internal combustion engine. Rather, the invention may be employed with efficacy in any heat exchanger application where internal pressurization of the heat exchanger causes the same to tend to grow in the direction generally transverse to the direction of elongation of the tubes.

Figure 2:
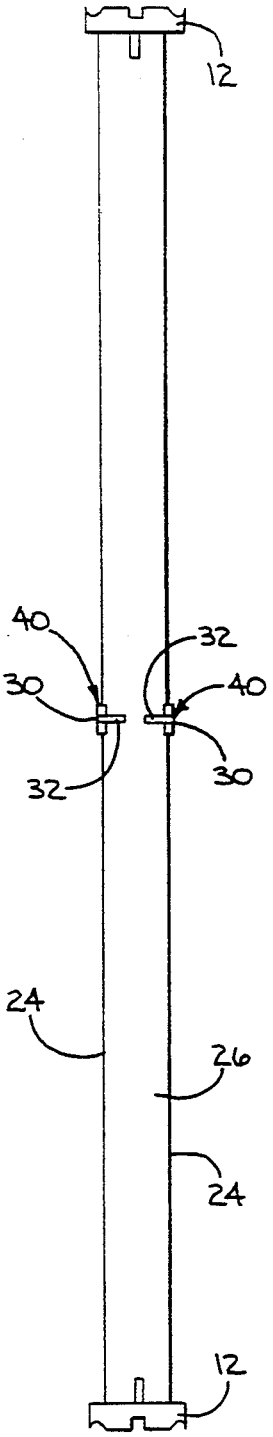
FIG. 2 is a side elevation of the radiator.
Figure 3:
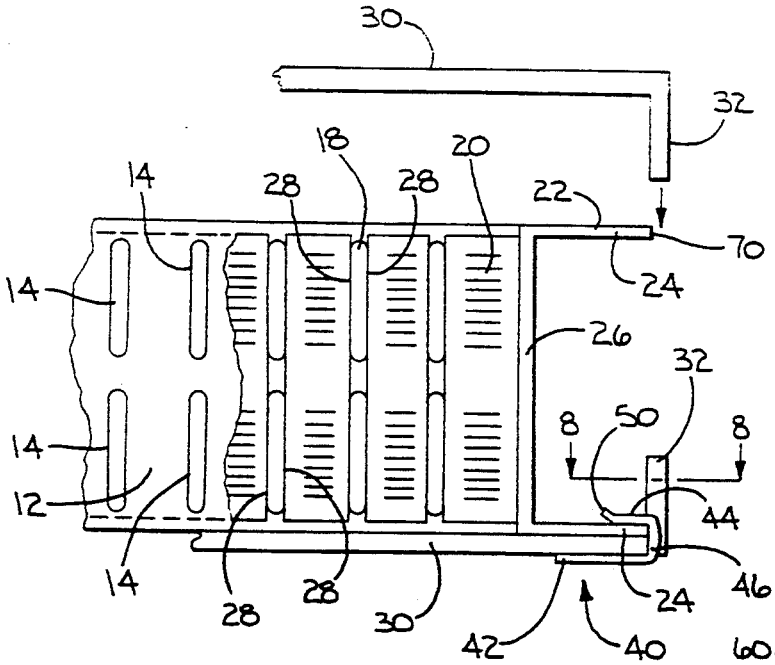
FIG. 3 is an enlarged, fragmentary, partially exploded sectional view of one side of the radiator.

Referring to FIGS. 1 and 2, the heat exchanger includes opposed, parallel, spaced, header plates 10 and 12 of known construction. As is well known, and as can be seen in FIG. 3, each of the header plates 10 and 12 includes a plurality of holes 14 for receiving the ends 16 of conventional flattened tubes 18. The flattened tubes 18 are elongated and extend between the headers 10 and 12. Their ends 16 are received in the holes 14 as mentioned previously and are secured and sealed thereto, as, for example, by soldering, brazing, welding or combination thereof.

Conventional serpentine fins 20 are located between adjacent ones of the tubes 18 as well as between endmost ones of the tubes 18 and side pieces 22 which sandwich the heat exchanger core defined by the tubes 18 and fins 20. The side pieces 22 extend between the headers 10 and 12 and as can be seen in FIG. 3, are in the form of outwardly opening channels having spaced channel legs 24 extending from a channel bight 26. Also as seen in FIG. 3, the serpentine fins 20 may be louvered and the same abut the flattened sides 28 of the tubes 18. Typically, the fins 20 will be brazed or soldered to the tube sides 28.

Returning to FIGS. 1 and 2, intermediate the ends of the core, at a location approximately mid-way between the headers 10 and 12, tie bars 30 are provided. The tie bars 30 are formed of a material having a high tensile strength and are generally configured as a rather shallow U to have transverse legs or ends 32 which overlay and embrace the outermost edge of a corresponding one of the channel legs 24. As can be seen in FIG. 3, the transverse ends 32 are fitted over the outer ends of the leg 24, that is, the ends of the legs 24 most remote from the bight 26 of the channel 22 during the manufacture of the heat exchanger and prior to the same being subjected to internal pressure. As a consequence of the foregoing, the side pieces 22 are provided with increased support intermediate their ends allowing the use of much longer tubes 18 than would be possible if the sole source of support for the side pieces 28 was provided by the headers 10, 12 themselves. Typically, particularly where the heat exchanger is a multiple tube row heat exchanger (FIG. 3 depicts a two tube row heat exchanger), it is desirable to place a tie bar 30 on each side of the core as can be seen in FIGS. 2 and 3.

As a consequence of the excellent tensile strength of the tie bar 30, a great deal of resistance to expansion of the heat exchanger in the direction transverse to the direction of elongation of the tubes 18 is provided. This in turn minimizes the fatiguing of heat exchanger components, including tube-to-header joints, that may fail after repeated pressure cycling as is well known. Of course, it may be desirable, in some instances, to place more than one tie bar 30 on each side of the core. For example, for extremely long cores, two or more tie bars 30 per side might be used.

In order to simplify installation of the tie bars 30, it is important that the transverse ends 32 be at or about 90 degrees to the main body of the tie bar 30. While an acute angle between the ends 32 and the main body of the tie bar 30 would provide some measure of hooklike retention for each of the tie bars 30, installation difficulties frequently make that impractical.

At the same time, with the transverse ends 32 only at 90 degrees to the tie bar 30, it will be appreciated that various stresses that may exist within the heat exchanger during use are quite likely to cause the transverse ends 32 to "walk" right off of the associated channel leg 24. When that occurs, of course, the support against pressurization will be immediately lost. Consequently, it is desirable to provide some means of holding the tie bars in place. While many sorts of fasteners could be employed, it is also desirable to provide a means that is easily installed and which is of low cost so as to minimize the expense of fabrication of the heat exchanger.

According to the present invention, positive retention of the tie bars 30 along with the foregoing desirable characteristics of a retention means is achieved through the use of a retaining clip. An exemplary embodiment of a retaining clip is generally designated 40 and is illustrated in perspective in FIG. 4. As can be appreciated from FIGS. 1 and 2, in the illustrated embodiment of the invention, four of the clips 40 are employed, one for each end of two different tie bars 30.

Figure 4:
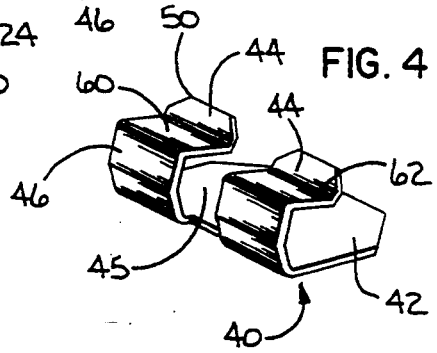
FIG. 4 is an enlarged, perspective view of a preferred form of a retaining clip used in the invention.
Figure 5:
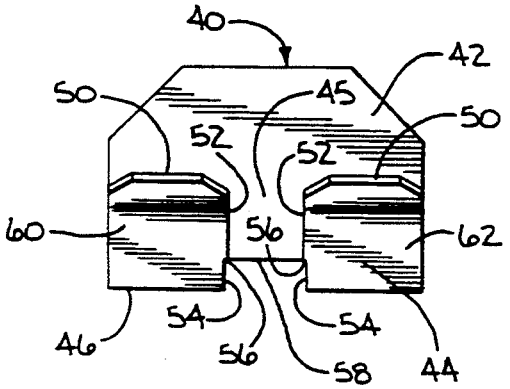
FIG. 5 is an elevational view of the retaining clip from one side thereof.

Turning to FIGS. 4–7, inclusive, the construction of the clip 40 will be described in detail. The same is generally U-shaped and has one flat leg 42, a leg 44 including a slot 45 and spaced from the leg 42 but approximately parallel thereto, and an interconnecting bight 46 into which the slot 45 also extends. Each clip 40 is formed of a resilient material, typically, but not always, metal. The legs 42 and 44 may be but need not be of the same length but in the preferred embodiment, the leg 44 is shorter than the leg 42. The leg 42 is also planar whereas the leg 44 includes a toe 50 which is bent away from the leg 42 and serves as a piloting surface as will be seen. That part of the slot 45 in the leg 44 includes opposed sides 52 as seen in FIG. 5. The slot 45 is tapered such that the sides 52 converge towards each other as the bight 46 is approached until retaining notches 54 at each side 52 are encountered. Each retaining notch 54 includes a retention surface 56 that is parallel to and faces the bight 46.

Adjacent the toes 50, the slot 45 is slightly wider than the width of the tie bar whereas at the surfaces 56 of the retaining notches 54, the slot 45 is somewhat narrower than the corresponding dimension of the tie bar 30. The notches 54, themselves, are of about the same width as the tie bar.

As can be seen in FIG. 4 and FIG. 5, the slot 45 between the legs 44 and in the bight 46 may extend partially into the leg 42 to terminate at an end 58. The purpose of extending the slot 45 through the bight 46 and partially into the leg 44 is to allow the sections 60 and 62 making up the leg 44 and on opposite sides of the slot 45 to separate from one another sufficiently that the clip 40 may be fitted onto the tie bar with the tie bar passing through the slot 45 between the leg section 60 and 62.

Figure 6:
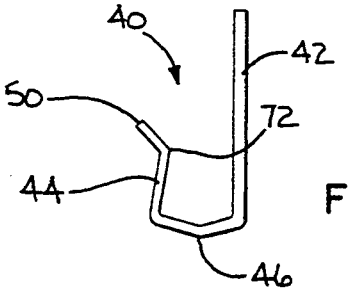
FIG. 6 is a view of the clip from a location taken approximately 90 degrees from the view shown in FIG. 5.
Figure 7:
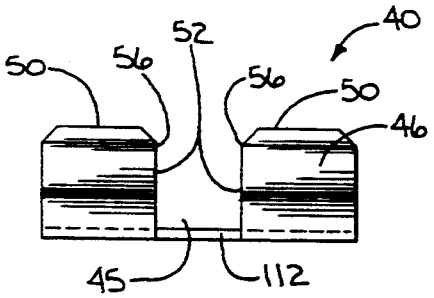
FIG. 7 is a view of the clip from the bottom thereof.
Figure 8:
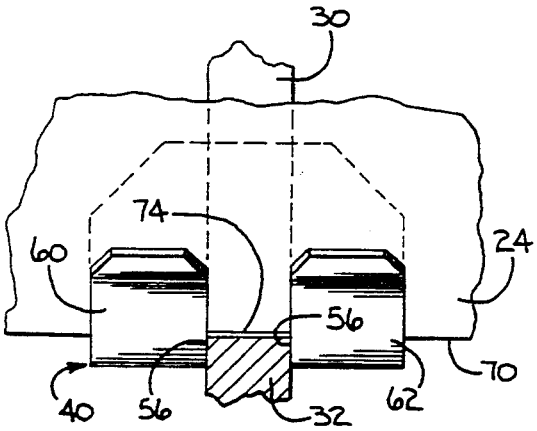
FIG. 8 is a sectional view taken approximately along the line 8—8 in FIG. 3.

With reference to FIGS. 3 and 8, the manner in which each clip 40 is installed will become apparent. Each tie bar 30 is placed along a corresponding side of the core with the transverse end 32 brought into overlying and embracing engagement with the outermost end 70 of a corresponding channel leg 24. The clip is then oriented such that the shorter leg 44 is disposed to be located within the channel defining the side piece 22 as can be seen in FIG. 3. In this connection, when the clip is in its unstressed state as illustrated in FIG. 6, the leg 44 angles inwardly somewhat toward the leg 42 and a nose 72 at the base of the toe 50 will be spaced from the leg 42 a distance less than the total thickness of the tie bar 30 and the channel leg 24. However, the distance between the end of the toe 50 and the leg 42 will be greater than the combined thickness of the four mentioned components and as a consequence, if the clip 40 is pushed from right to left as viewed in FIG. 3, with the slot 45 between the leg sections 60 and 62 aligned with the tie bar transverse end 32, the legs 42 and 44 will be spread somewhat to allow the clip 40 to assume the position illustrated in FIG. 3. At the same time, the leg sections 60 and 62, by reason of the tapered surfaces 52, will be spread somewhat by the transverse end 32 as the clip 40 moves fully onto the channel leg 24. In this respect, the location of the notches 54 is selected along with the thickness of the tie bar 32 such that when the clip 40 is moved fully onto the leg 24 as shown in FIG. 3, the retaining surfaces 56 will move just past the inner side 74 (FIG. 8) of the transverse end 32. The resilience of the clip will then cause the leg sections 60 and 62 to snap together with the surfaces 56 behind the transverse end 32 to prevent removal of the clip. Thus, the legs 42 and 44 together with the bight 46 serve as a securing means whereby the tie bar 30 is secured at its end to the side piece 22 while the notches 54 in the surfaces 52 serve as a retaining means which grasp the transverse end 32 of the tie bar 30 to prevent the clip 40 from vibrating loose or otherwise becoming loose as a result of pressure or thermal cycling.

Alternatively, at one end, the clip 40 can be first applied to the transverse end 32 of the tie bar 30 and then snapped onto the channel leg 24.

In some cases, the channels defining the side pieces 22 may open toward the core. In such cases, one need only place clip receiving openings in the channel bights 26 to make use of the clips of the invention.

From the foregoing, it will be appreciated that the unique combination of a tie bar and clips therefor provides simple and inexpensive and readily usable means for providing support for a heat exchanger against the pressure acting within flattened tubes in a direction transverse to their lengths. No special tools for installation purposes are needed. The tie bars are easily formed and do not have hooklike ends that would be difficult to install on the channel legs 24. Furthermore, the use of the clips 40, which in a unitary assembly provide both for securing the tie bar ends to the side pieces 22 and a means for retaining the clips in place even when subjected to forces commonly found in heat exchangers and their operating environments, assure that positive support will be provided at all times.

We claim:

1. A radiator comprising:

a pair of spaced headers, each having a plurality of tube receiving holes with the tube receiving holes in one header being aligned with and facing the tube receiving holes in the other;

a plurality of elongated tubes extending between and secured to said headers, and having opposite ends sealingly received in aligned ones of said holes;

fins extending between and secured to adjacent ones of said tubes to define, with said tubes, a radiator core;

a pair of side pieces sandwiching said core, said pieces extending between said headers, each said side piece being a channel having spaced legs and oriented to open away from the core;

at least one tie bar extending between said side pieces to provide restraint and pressure resistance to said core in a direction generally transverse to the direction of elongation of said tubes, each said tie bar having a transverse end fitted over one of the channel legs; and at least one clip at one end of said tie bar and fitted over the tie bar and one of said side pieces to secure the two together, said clip having a first securing section that fits over said tie bar end and said one leg to secure said tie bar to said one leg, and a second section including retaining means that fits over and grasps said tie bar to hold said first section in place against movement due to vibration, pressure cycling or thermal cycling.

2. The radiator of claim 1 wherein said clip is resilient and U-shaped and said first section comprises both legs and the bight of the U-shaped clip, one of said legs of said U-shaped clip including a slot having a width about equal to the corresponding dimension of the transverse end so as to receive the same, and at least one retaining notch in a side of said slot for engagement with said transverse end to hold said clip thereon.

3. The radiator of claim 2 wherein there are two retaining notches, one on each side of said slot and aligned with each other, said slot, at said retaining notches being somewhat narrower than said corresponding dimension.

4. The radiator of claim 3 wherein said notches have retaining surfaces facing said bight, and said slot has tapered sides extending to said retaining surfaces.

5. A radiator comprising:

a pair of spaced headers, each having a plurality of tube receiving holes with the tube receiving holes in one header being aligned with and facing the tube receiving holes in the other;

a plurality of elongated tubes extending between and secured to said headers, and having opposite ends sealingly received in aligned ones of said holes;

fins extending between and secured to adjacent ones of said tubes to define, with said tubes, a radiator core;

a pair of side pieces sandwiching said core, said pieces extending between said headers;

a pair of tie bars, each extending between said side pieces and on opposite sides of said core, each tie bar being the shape of a shallow U with its legs embracing an outermost part of a corresponding side piece; and a plurality of resilient clips, one for each end of said tie bars, said clips being of one piece construction and having a securing section for securing a corresponding tie bar end to the associated side piece, and a retaining section that grasps one of said end piece and said tie bar to retain the clip in place against dislodging forces.

6. The radiator of claim 5 wherein each said clip is formed of a resilient material and includes a pair of spaced legs joined at one end by a bight, one of said legs being slotted along its length to a width similar to the corresponding tie bar dimension, the slot narrowing as the bight is approached, the slot further having transverse retaining surfaces intermediate its ends and being somewhat narrower than said corresponding tie bar dimension thereat.

7. The radiator of claim 6 wherein said side pieces are channels having channel legs extending away from said core and said tie bar legs engage the outermost part of an associated channel leg, each said clip having its legs sandwiching a corresponding tie bar end and the associated channel leg with the bight outwardly of the channel leg, and the tie bar leg within the slotted clip leg and the retaining surfaces engaging the tie bar leg oppositely of the bight.

8. The radiator of claim 5 wherein said retaining section grasps said tie bar.

* * * * *